United States Patent [19]

Lasher et al.

[11] 4,017,066

[45] Apr. 12, 1977

[54] SET SEPARATOR

[75] Inventors: David C. Lasher, Lewisville, Tex.; Kenneth F. Blanchard, Macedon, N.Y.

[73] Assignee: Xerox Corporation, Stamford, Conn.

[22] Filed: June 4, 1976

[21] Appl. No.: 692,829

[52] U.S. Cl. ..... 271/80; 271/239; 271/251; 214/6 N

[51] Int. Cl.[2] ..... B65H 29/22; B65H 33/08

[58] Field of Search ..... 271/80, 220, 221, 239, 271/240, 250, 251; 214/6 N, 6 S

[56] References Cited

UNITED STATES PATENTS

| | | | |
|---|---|---|---|
| 3,719,266 | 3/1973 | Korn et al. | 214/65 X |
| 3,735,978 | 5/1973 | Turner et al. | 271/80 X |
| 3,923,299 | 12/1975 | Taylor et al. | 271/221 |

FOREIGN PATENTS OR APPLICATIONS

| | | | |
|---|---|---|---|
| 956,664 | 4/1964 | United Kingdom | 214/65 |

*Primary Examiner*—Robert W. Saifer
*Attorney, Agent, or Firm*—Sheldon F. Raizes

[57] ABSTRACT

A set separator for offsetting sets of sheets of paper is provided. A first set of paddle wheels is provided which, in one position, directs a sheet of paper forwards towards a stop wall and to one side, and in a second position directs the sheet of paper forwards towards the wall and to the opposite side. A pair of sideposts is spaced apart more than the dimension of the leading edge of the sheet of paper so that only one post is engaged by one side edge of a sheet of paper, when the paddle wheels are in the first position, and only the other post is engaged by the opposite side edge of a sheet of paper when the paddle wheels are in the second position. The sideposts rotate in directions opposite to one another to move the sheet forwards toward the wall. A second pair of paddle wheels, also spaced apart more than the dimension of the leading edge of the sheet of paper so that only one paddle wheel engages the sheet of paper at a time, is located adjacent the stop wall. The second pair of paddle wheels rotates in directions opposite to one another about axes which extend in the same general direction that the sheet of paper moves. A particular one of the second pair of paddle wheels engages the sheet of paper at a particular time to urge the paper in the same side direction that the first pair of paddle wheels is uging the sheet. The second pair of paddle wheels acts to keep the sheet from riding up the wall. The first pair of paddle wheels is in one position until the required number of sheets are received to make up one set. Then the first pair of paddle wheels is changed to its other position to direct the sheets of another set toward the opposite side of the separator to laterally offset the sets from one another.

4 Claims, 3 Drawing Figures

SET SEPARATOR

DESCRIPTION OF THE INVENTION

In copier/duplicating machines, one method of sorting sets of copies is by providing a transport assembly sorter, which directs the different sets of copies into separate bins. Another method is to direct the different sets of copies into the same bin, one on top of the other, only each set is significantly offset from the adjacent set in order for an operator to readily distinguish the different sets. It is the latter method to which this invention is directed.

It is an object of this invention to provide a set separator with a set offsetting mechanism, which is reliable as well as economical to make.

Other objects of the invention will become apparent from the following description with respect to the drawings wherein.

Figure 1:
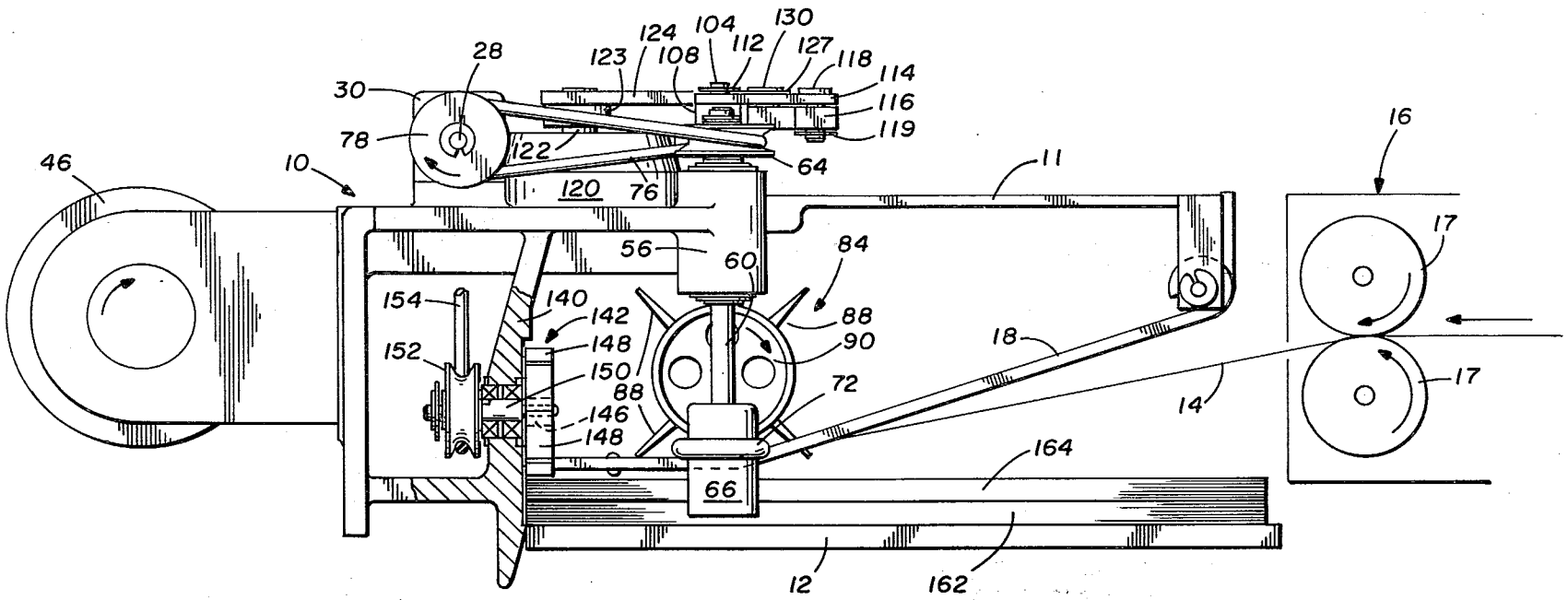
FIG. 1 is a side view of a set separator assembly.

Referring to FIG. 1, there is illustrated a paper stacker main frame 10, a paper tray 12, and sheet of paper 14 being delivered to the stacker from a paper transport assembly designated generally by reference numeral 16. The transport assembly may be connected to a xerographic engine or other duplicating medium for delivering copies to the stacker. The transport assembly includes nip rolls 17 for transporting sheets of paper from a copier/duplicator onto the stacker. Three spaced guide members 18 are supported by the frame 10 and are inclined toward the paper tray 12 to direct the sheet 14 toward the paper tray 12 when the sheet emerges from the paper transport 16. The paper tray 12 is operatively connected to a step motor (not shown) for selectively lowering or lifting the paper tray upon demand. A paper-height sensor (not shown) senses the height of the stack of paper above a certain level at which point the sensor causes actuation of the step motor to lower the paper tray a given amount. Ordinarily, the paper tray 12 will be lowered each time after seven sheets of paper are added to the stack.

Figure 2:
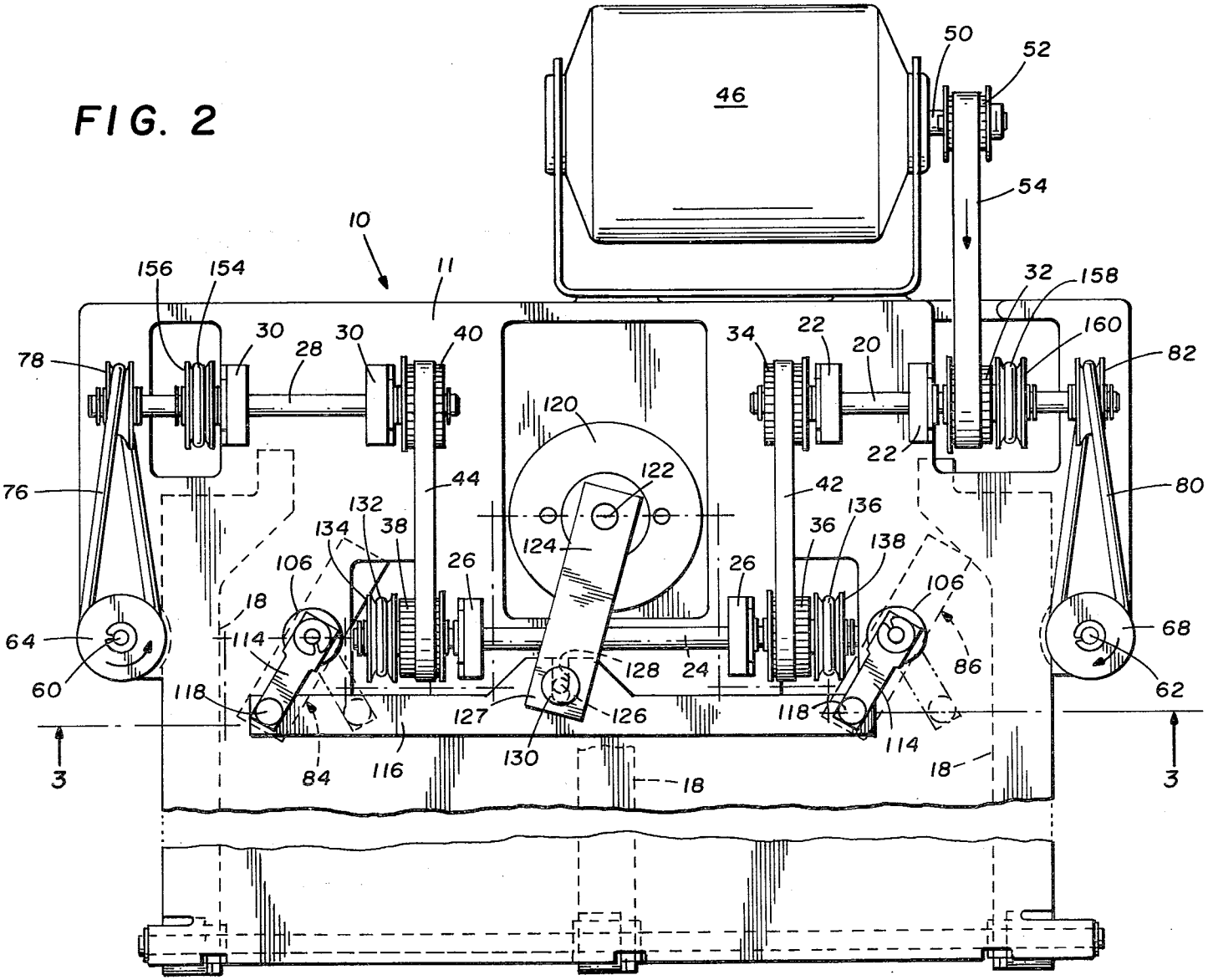
FIG. 2 is a top view of a set separator assembly.

Referring to FIG. 2, the frame 10 has a generally planar base 11. A shaft 20 is rotatably mounted on a pair of flanges 22 extending upwardly from the main frame base 11, a shaft 24 is rotatably mounted on a pair of flanges 26 extending upwardly from the base 11, and a shaft 28 is rotatably mounted on a pair of flanges 30 which are also extending upwardly from the main frame base 11. Two energy transfer toothed pulleys 32, 34 are keyed to the shaft 20. Two energy transmitting toothed pulleys 36 and 38 are keyed to the shaft 24, and an energy transmitting toothed pulley 40 is keyed to the shaft 28. A toothed belt 42 interconnects the pulleys 34 and 36, and a toothed belt 44 interconnects the pulleys 38 and 40. A motor 46 is secured to the frame 10 and rotatably drives a shaft 50 which has a toothed pulley 52 keyed thereto. A toothed belt 54 interconnects the pulleys 52 and 32. The belts 54, 42, and 44 interconnect the shafts 20, 24 and 28, respectively, with the motor 46 to be rotated thereby.

Figure 3:
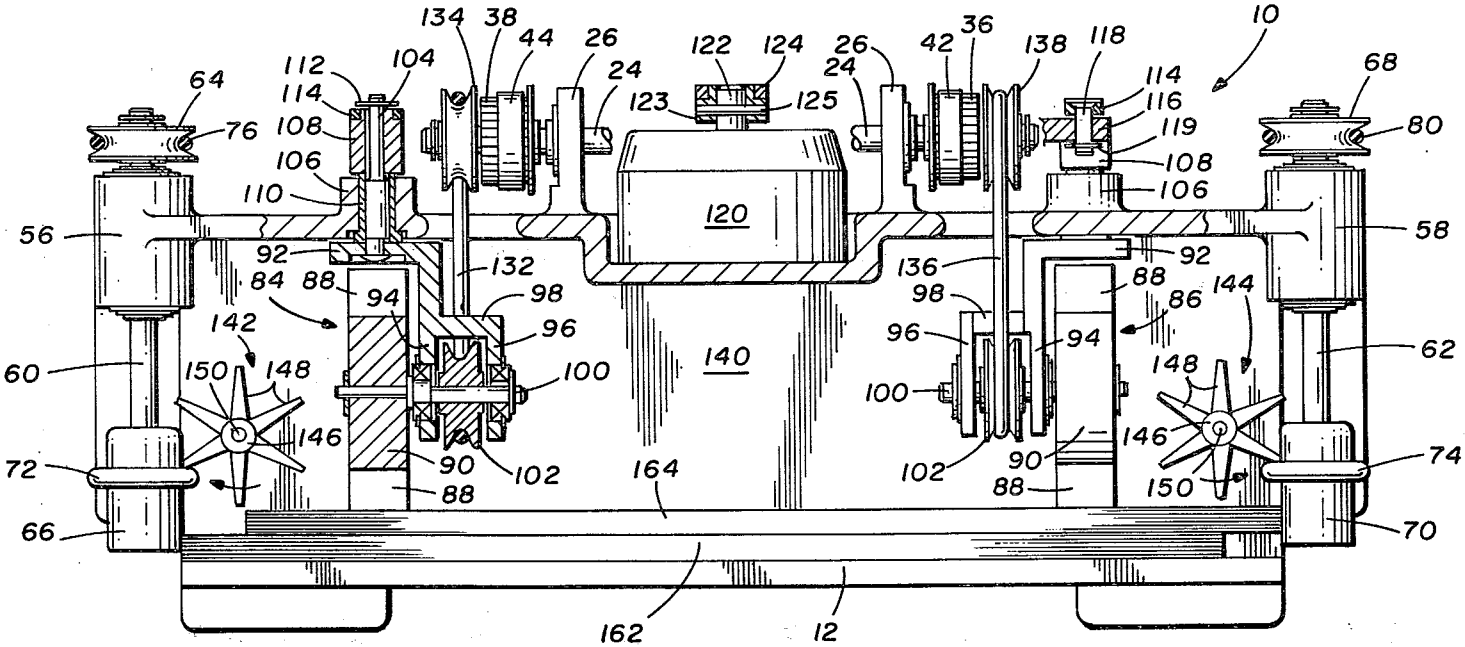
FIG. 3 is a view of the set separator assembly taken along section line 3—3 of FIG. 2.

Referring to FIG. 3, a pair of bosses 56 and 58 are located on the main base 11 of the frame 10 and have vertical shafts 60 and 62, respectively, rotatably journaled therein. A belt pulley 64 is keyed to the upper end of the shaft 60, and a cylindrical sleeve 66 is fitted over the lower end of the shaft 60 and fixed thereto for rotation therewith. A belt pulley 68 is keyed to the upper end of the shaft 62, and a cylindrical sleeve 70 is fitted over the lower end of the shaft 62 and secured thereto for rotation therewith. An integral annular rib 72 extends from the outer periphery of the sleeve 66, and an integral annular rib 74 extends from the outer periphery of the sleeve 70. The sleeves 66 and 70 are made of Delrin material. An O-ring belt 76 interconnects the pulley 64 with a pulley 78 (FIG. 2) which is keyed onto the rotatable shaft 28 in order to transmit rotation to the vertical shaft 60. A belt 80 interconnects the pulley 68 to a pulley 82 (FIG. 2) which is keyed to the shaft 20 to transmit rotation to the vertical shaft 62. The annular ribs 72 and 74 limit the extent that the paper 14 can ride up the sleeves 66 and 70, respectively. The shaft 60 and its sleeve 66 and the shaft 62 and its sleeve 70 will hereinafter be referred to as left and right sidestop posts, respectively.

Referring to FIGS. 2 and 3, a pair of spaced paddle-wheel assemblies 84 and 86 extend downward from the base 11 and are mounted for rotation about aligned horizontal axes. Each paddle-wheel assembly includes a paddle wheel with a plurality of flexible blades 88 extending from a solid core 90. The paddle wheels are a cast polyurethane. Supporting each paddle wheel is a bracket 92 which has an offset U-shaped configuration at its lower end comprising a pair of spaced legs 94, 96 and a bridge portion 98 joining the legs. A horizontally extending shaft 100 is rotatably journaled in the legs 94 and 96. The paddle wheel is secured to one end of the shaft 100, and a pulley 102 is located between the legs 94 and 96 and is keyed to the shaft 100. A pin 104 extends through the upper end of the bracket 92 and through a boss 106 on the base 11 and through a collar 108. A cylindrical bearing sleeve 110 is located in the boss 106 to provide a bearing for the pin 104 on which the pin 104 rotates. The collar 108 and the bracket 92 are keyed to the pin 104 for rotation therewith. A retainer ring 112 is secured to the upper end of the pin 104 to secure the paddle-wheel assembly to the boss 106. An arm 114 is welded to the collar 108 and extends in a direction parallel to the base 11 and is spaced upwardly therefrom. A bar 116 is located above the base 11 and is pivotally secured at each end thereof to a respective one of the arms 114 by a pin 118 extending through the free end of the arm 114 and the end of the bar 116. A retainer ring 119 is secured to the pin 118 to hold the bar 116 on the pin 118. A rotary solenoid 120 is secured to the base 111 and has a vertical shaft 122 extending upwards. A collar 123 is secured to the shaft 122 by a roll pin 125 which extends through the collar and shaft. A link 124 is welded to the collar 123. A pin 126 extends through an opening in the end 127 of the link and through a slot 128 in the bar 116 over which the link 124 lies. The pin 126 has an enlarged head 130 welded to the link 124. The slot 128 and the pin 126 are so proportioned that rotational movement of the end 127 of the link 124 will be transmitted by the pin to the bar 116 to shift the bar in the same direction and thereby rotate the arms 114 between the full position and the phantom position shown in FIG. 2 to cause rotation of the paddle wheels 84 and 86 to change the angular position of the paddle wheels. The solenoid is spring biased whereby the arms 114 and the paddle wheels 84, 86 take the position as shown in full in FIG. 2 when the solenoid is off. Actuation of the solenoid will cause rotation of the arms 114 to the position shown in phantom in FIG. 2. In FIG. 3, the paddle-wheel assemblies are shown in a position halfway between the full and phantom positions in FIG. 2 for clarity. An O-ring belt 132 interconnects the pulley 102 of the paddle-wheel assembly 84 to a pulley 134, which is keyed to the shaft 24, and an O-ring belt 136 interconnects the pulley 102 of the paddle-wheel assembly 86 to a pulley 138, which is also keyed to the shaft 24, for transmitting rotation to the paddle wheels 90.

Referring to FIGS. 1 and 3, a back wall 140 extends downwards from the base 11 and has a pair of paddle-wheel assemblies 142 and 144 secured thereto. Each paddle wheel comprises a core 146 with a plurality of flexible blades 148 extending therefrom which are secured to a shaft 150 which is rotatably mounted to the wall 140. The paddle wheels are a cast polyurethane. A pulley 152 is keyed to the shaft 150, and O-ring belt 154 interconnects the pulley 152 for paddle wheel 142 to a pulley 156 (FIG. 2), which is keyed to the shaft 28, and an O-ring belt 158 interconnects the pulley (same as pulley 152, only not shown) for the paddle wheel 144 to a pulley 160 (FIG. 2), which is keyed to the shaft 20, for providing rotation of the paddle wheels. The paddle wheels 142 and 144 will be driven in the opposite rotational directions with the paddle wheel 144 rotating in a counterclockwise direction (FIG. 3) and paddle wheel 142 rotating in a clockwise direction (FIG. 3). The left and right posts 60 and 62 will also be driven in opposite rotational directions with the post 62 being driven in a clockwise direction, and the post 60 being driven in a counterclockwise direction (FIG. 2). The paddle wheels 142 and 144 are spaced apart so that only one paddle wheel will engage the sheet of paper 14 at a time. The posts 66 and 70 are spaced apart slightly more than a distance of the dimension of the leading edge of a sheet of paper entering the bin so that only one post will engage the side edge of a sheet at a time. The paddle wheels 84 and 86 rotate in the same direction, clockwise (FIG. 1), and are spaced to simultaneously engage a sheet of paper to direct the same forward and either to the left or to the right depending on the position of the paddle wheels. The centerlines of the sidestop posts 60 and 62 and the centerlines of the paddle wheels 84 and 86 are equaldistant from the back wall 140 so that the paddle wheels and a particular sidestop post will engage the sheeet 14 almost simultaneously. However, the centerline of the posts may be further away from the back wall 140 than the centerline of the paddle wheels so a particular post is engaged by the sheet 14 prior to engaging the paddle wheels.

In operation, assume that a first stack 162 of copy sheets has already been directed to the left side of the bin (FIG. 3). Now a second stack 164 of copy sheets will be directed to the right side of the bin, and the paddle wheels 84 and 86 will be in the position as shown in full in FIG. 2. The belt 54 is rotated by the motor 46 in the direction of the arrow associated therewith thereby effecting clockwise rotation of the left paddle wheel 142 and counterclockwise rotation of the right paddle wheel 144 (FIG. 3), counterclockwise rotation of the sidestop post 60 and clockwise rotation of the sidestop post 62 (FIG. 2), and clockwise rotation of the paddle wheels 84 and 86 (FIG. 1). As the sheet 14 leaves the paper transport 16, it engages the paper guides 18 and is directed downwards toward the tray 12 whereby it engages either the tray 12, if the tray is empty, or it engages the uppermost sheet of a stack of sheets on tray 12. The nip rolls 17 move the sheet 14 into engagement with the paddle wheels 84 and 86 which, due to their position as shown in full in FIG. 2, impart a force on the paper directing the same toward the stop wall 140 and to the right-hand side toward the post 62. The right-hand edge of the sheet 14 engages the rotating post 62 which acts as a sidestop and also acts to transport the sheet toward the wall 140 due to the frictional engagement of the sleeve 70 with the edge of the paper. The dimension of the leading edge of the paper is such that only the right sidestop post 62 is engaged, while the left rotating sidestop post 60 does not engage the sheet 14. The rib 74 on the post 62 keeps the edge of the sheet from riding up the post. As the front edge of the sheet moves forward and approaches the wall 140, it will engage the right paddle wheel 144 which also exerts a force to the right on the sheet to urge the leading edge of the sheet into the corner. The paddle wheel 144 also serves to keep the leading edge of the paper from riding up the wall 140 and thereby from curling the sheet. A stack of papers will be formed as indicated by reference numeral 164. After the desired number of sheets have been passed into the bin to complete a set, the solenoid 120 is energized to shift the bar 116 to the right and thereby rotate the paddle wheels 84 and 86 in a counterclockwise direction (FIG. 2) to a position, shown in phantom in FIG. 2, where the force exerted on the paper by the paddle wheels 84 and 86 will be in a direction toward the wall 140 and to the left (FIG. 3). When the next sheet of paper engages the paddle wheels 84 and 86, the paddle wheels will urge the same to the left whereby the left edge of the paper will engage the left rotating sidestop post 66 which will help urge the paper towards the wall 140. The sheet will then engage the paddle wheel 142 which will urge the sheet to the left to urge the leading edge of the sheet into the corner. A stack of papers will be formed on top of set 164 in the same relative position as set 162. The paddle wheel 142 will also act to prevent the front edge of the sheet from riding up the wall 140 and thereby from curling the sheet. The sidestop posts are spaced approximately five-eighth inch further apart than the dimension of the leading edge of the sheet of paper being utilized. Therefore, a five-eighth inch stack offset will occur whereby the separate sets of different copies will be readily determined by a machine operator.

What is claimed is:

1. A set separator for offsetting sets of sheets comprising: support means having stop means; means for moving a sheet toward said stop means; said sheet moving means including a first pair of paddle wheels rotatably carried by said support means, each of said paddle wheels comprising a main portion having a plurality of circumferentially spaced flexible members extending outwardly therefrom; said paddle wheels being rotatable about aligned axes of rotation; said paddle wheels being in the path of travel of the sheet and being spaced apart a distance less than the dimension of the leading edge of the sheet; means for simultaneously shifting said paddle wheels from a first position, wherein the force exerted thereby on a sheet is in the general direction of movement of the sheet and to one side, to a second position wherein the force exerted thereby is in the general direction of movement of the sheet and to the opposite side, and for simultaneously shifting said paddle wheels back to said first position; means for rotating said paddle wheels in the same direction to move the sheet toward said stop means; said sheet moving means further including a pair of vertical sideposts rotatably supported by said support means and spaced apart in a direction transverse to the direction of sheet travel; said spacing between said posts being greater than the dimension of the leading edge of the sheet; said paddle wheels in said first position urging the side edge of the sheet against one of said posts and when in said second position, directing the opposite side edge of the sheet against the other of said posts; and means for rotating said posts in opposite directions to each other for moving the sheet toward said stop means.

2. The structure as recited in claim 1 wherein said sideposts each has an annular rib thereon so located above a sheet to prevent the side edge of the sheet from riding up the post above the level of the rib.

3. The structure as recited in claim 1 further comprising: a second pair of paddle wheels rotatably mounted on said support means adjacent said stop means and spaced apart from each other in the same general direction as said posts are spaced; said second pair of paddle wheels being spaced apart greater than the dimension of the leading edge of the sheet; each said paddle wheel of said second pair being rotatably mounted on said support means about an axis extending in the general direction of travel of the sheet; each of said second pair of paddle wheels comprising a main portion having a plurality of circumferentially spaced flexible members extending outwardly therefrom; and means for rotating said second pair of paddle wheels in opposite directions to one another; the particular one of said second pair of paddle wheels engaging a sheet at a particular time urging the sheet in the same side direction as said first pair of paddle wheels is urging the sheet.

4. The structure as recited in claim 3 wherein said sideposts each has an annular rib thereon so located above a sheet to prevent the side edge of the sheet from riding up the post above the level of the rib.

* * * * *